US006393949B1

(12) United States Patent
Ho

(10) Patent No.: US 6,393,949 B1
(45) Date of Patent: May 28, 2002

(54) RATCHET SCREWDRIVER

(75) Inventor: Shih-Chi Ho, Taichung Hsien (TW)

(73) Assignee: Yen Hsing Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/748,444

(22) Filed: Dec. 27, 2000

(51) Int. Cl.[7] ..... B25B 13/46
(52) U.S. Cl. ..... 81/62; 192/43.1
(58) Field of Search ..... 81/60–63.2; 192/43, 192/43.1, 43.2

(56) References Cited

U.S. PATENT DOCUMENTS 5,573,093 A * 11/1996 Lee ..... 192/43.2
5,749,272 A * 5/1998 Phan ..... 81/62
5,974,915 A * 11/1999 Chou ..... 81/63.1
6,047,801 A * 4/2000 Liao ..... 192/43.2
6,059,083 A * 5/2000 Tseng ..... 192/43.1
6,151,995 A * 11/2000 Shu ..... 81/62
6,240,810 B1 * 6/2001 Ho ..... 81/62
6,305,248 B1 * 10/2001 Rowlay ..... 81/62

* cited by examiner

*Primary Examiner*—Joseph J. Hail, III
*Assistant Examiner*—David B. Thomas
(74) *Attorney, Agent, or Firm*—Harrison & Egbert

(57) ABSTRACT

A ratchet screwdriver including a main body, two stop blocks, a switching block, a locating member, a recovery elastic piece. The main body is provided with an outer threaded portion having a hole for receiving a ratchet rod. A shell tube is fitted over the main body such that a switching ring is fitted over the shell tube. The switching ring is provided with a retaining groove for retaining a protruded block of the switching block. The shell tube and the switching ring are pressed against the main body by a pressing member having inner threads which are engaged with the outer threaded portion of the main body.

1 Claim, 7 Drawing Sheets

RATCHET SCREWDRIVER

BACKGROUND OF THE INVENTION

1. Field of the Invention

The present invention relates generally to a hand tool, and more particularly to a ratchet screwdriver.

2. Description of Related Art

As shown in FIGS. 1 and 2, a ratchet screwdriver 10 of the prior art comprises a handle 11 having a main body 12 which is provided at the front end thereof with a shaft hole 14 with a core hole 13. A shaft 17 is pivoted to the shaft hole 14 and is provided with a gear 15 and a protruded pillar 16. A stop plate 19 is disposed in an insertion slot 18 of the main body 12. The gear 15 is actuated by two check plates 20 which are provided with a dial button seat 22 having two elastic press plates 21. A housing 24 is fitted over the main body 12 such that a retaining cut 25 of the housing 24 is engaged with a projection 26 of the main body 12. The housing 24 has a position confining hole 23. The main body 12 is further provided with a locking member 28 having a bearing hole 27 which is slidably fitted over the shaft 17.

The prior art ratchet screwdriver 10 is defective in design because the main body 12 is not provided with sufficient torsional strength, because the check plates 20 are too thin, and because the adjustment of the dial button seat 22 cannot be easily done, and also because assembly of the ratchet screwdriver 10 is not cost-effective.

BRIEF SUMMARY OF THE INVENTION

The primary objective of the present invention is to provide a ratchet screwdriver which is free of the deficiencies of the prior art ratchet screwdriver described above.

The features and the advantages of the present invention will be readily understood upon a thoughtful deliberation of the following detailed description of the present invention with reference to the accompanying drawings.

DETAILED DESCRIPTION OF THE INVENTION

Figure 1:
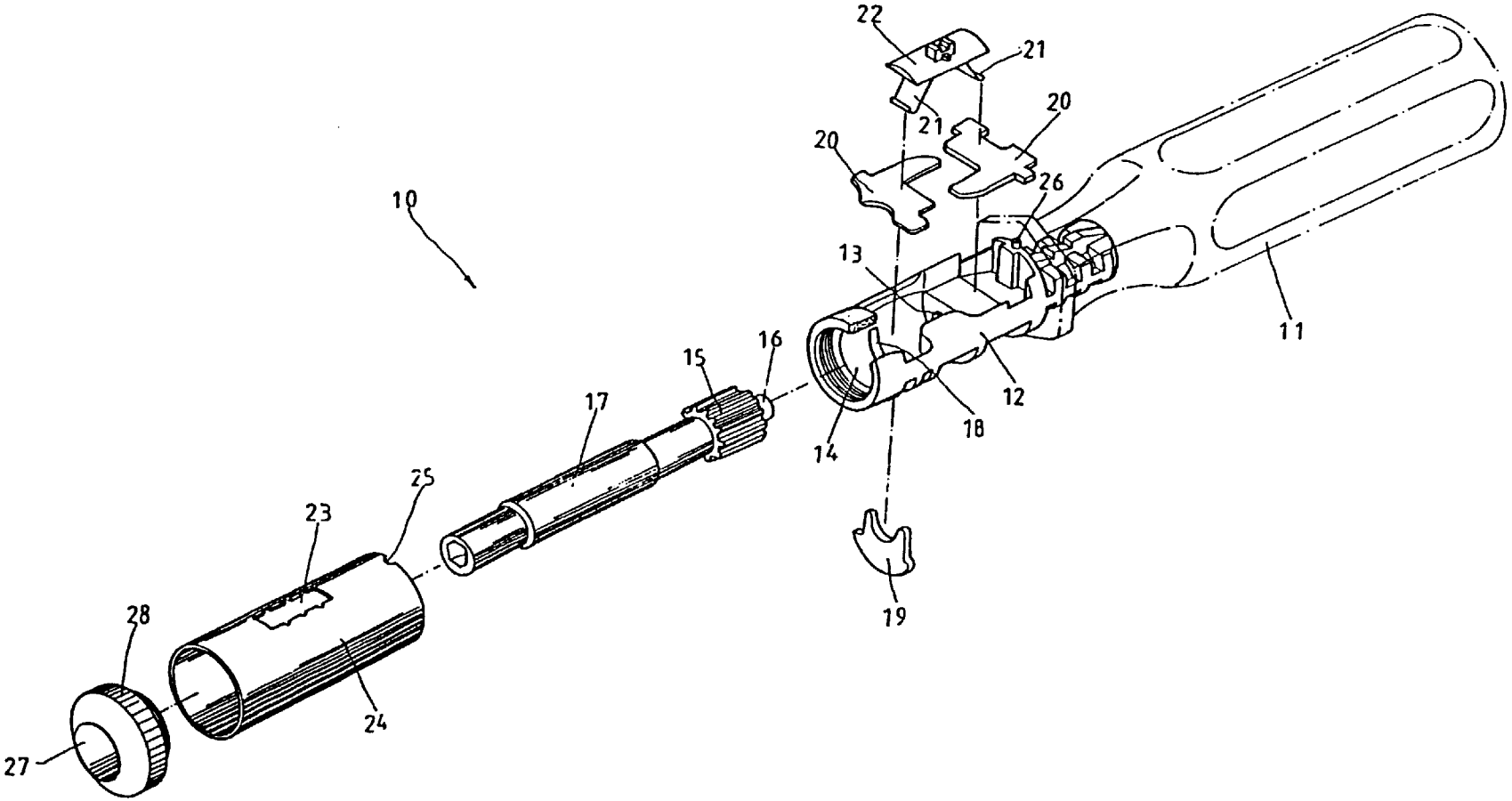
FIG. 1 PRIOR ART
FIG. 1 shows an exploded view of a ratchet screwdriver of the prior art.
Figure 2:
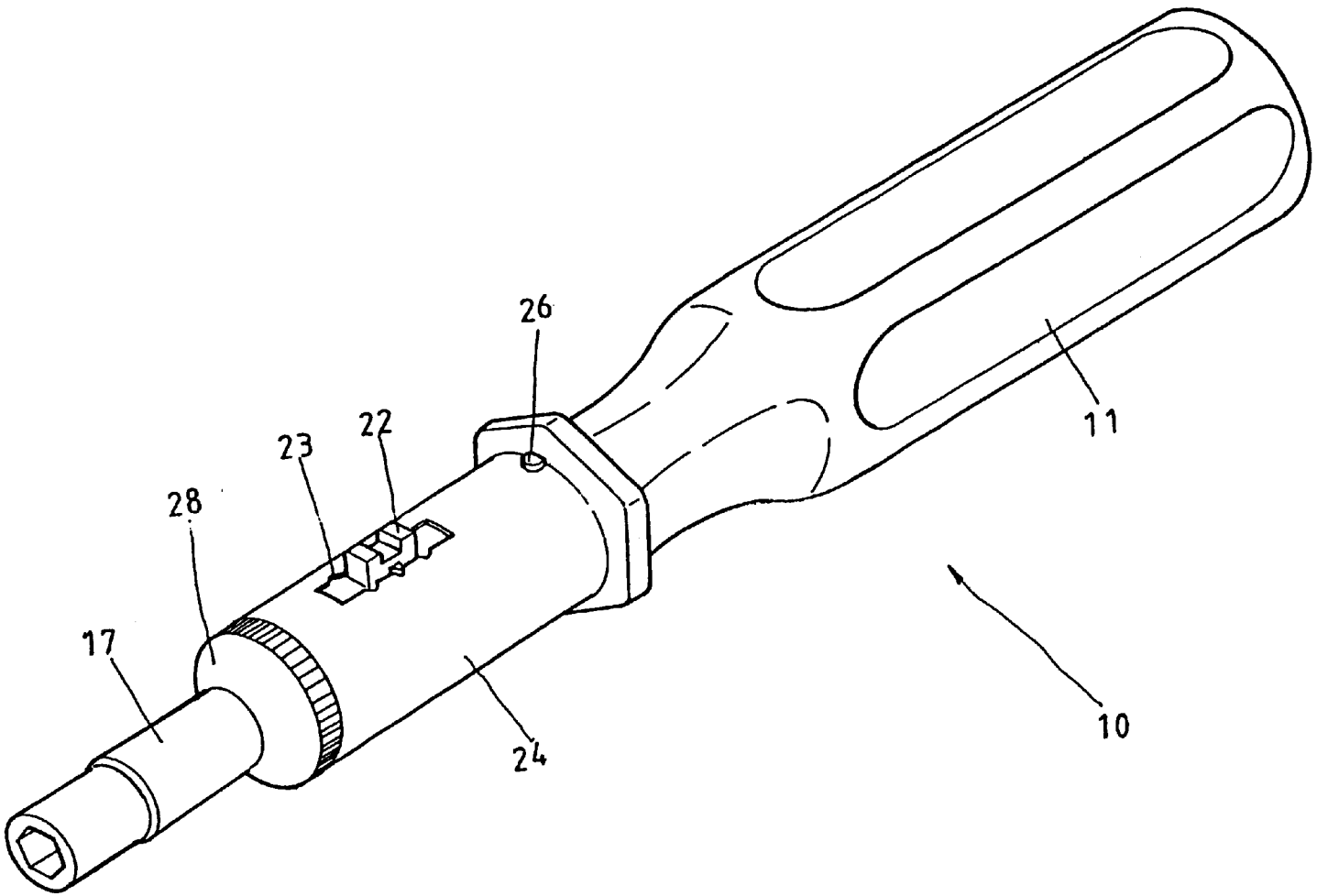
FIG.2 PRIOR ART
FIG. 2 shows a perspective view of the ratchet screwdriver of the prior art.
Figure 3:
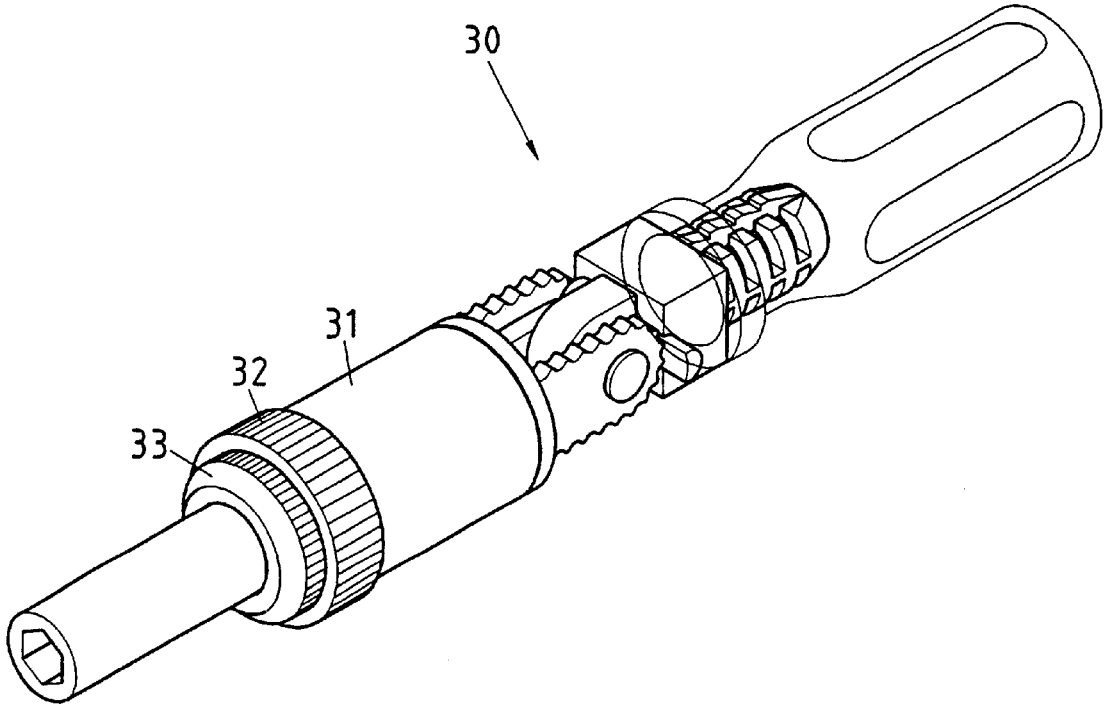
FIG. 3 shows a perspective view of the present invention.
Figure 4:
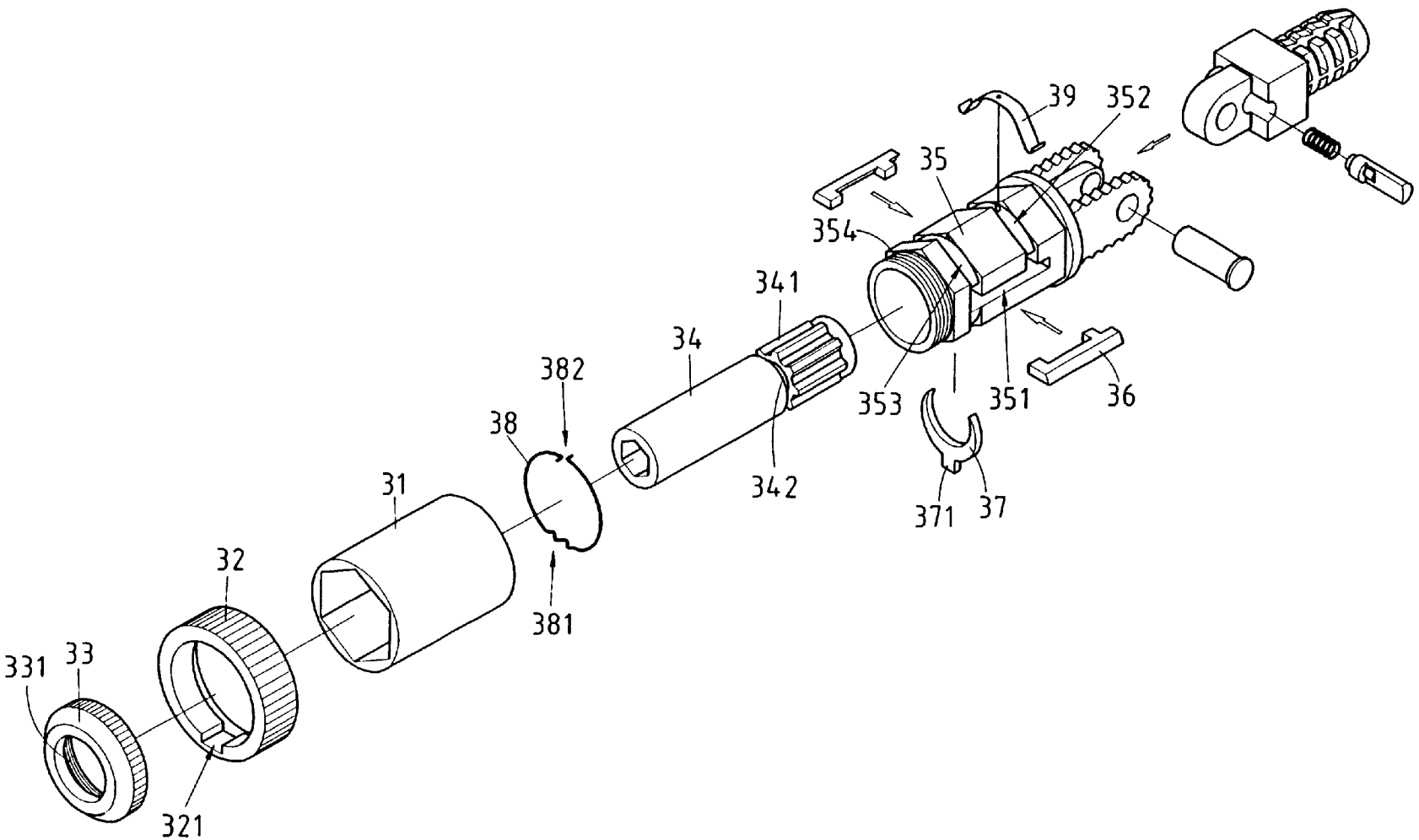
FIG. 4 shows an exploded view of the present invention.
Figure 5:
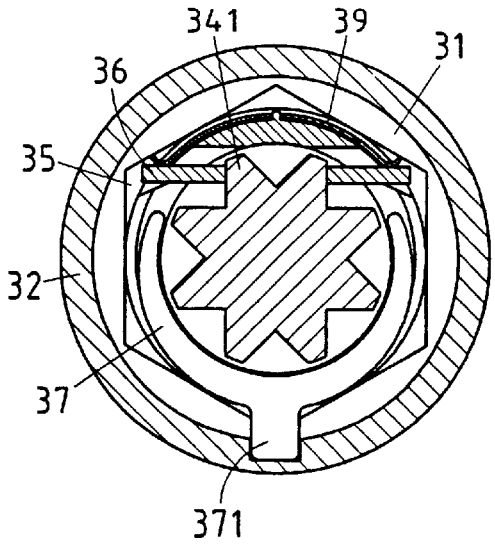
FIGS. 5–7 are cross-sectional views of the present invention.
Figure 6:
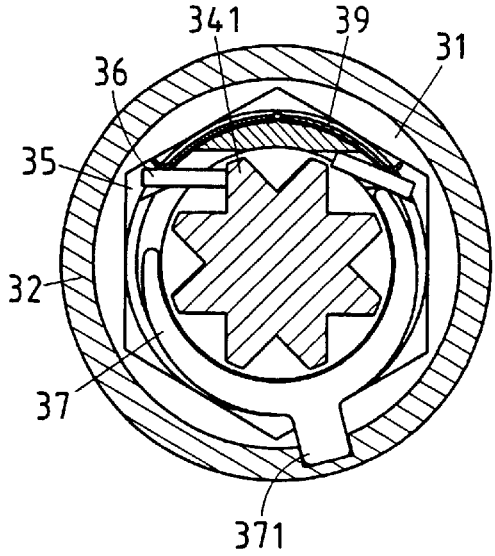
Figure 7:
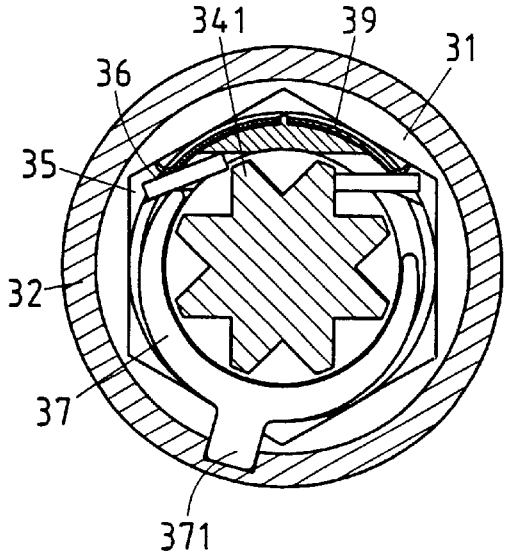
Figure 8:
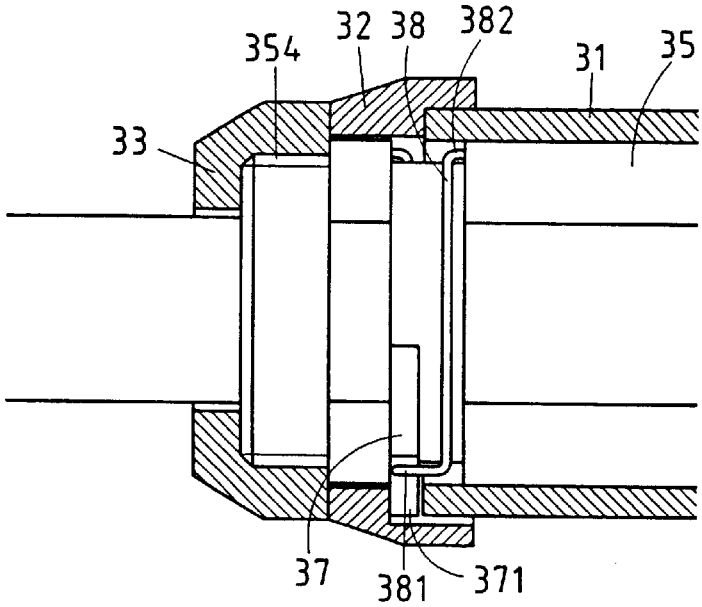
FIG. 8 shows a longitudinal sectional view of the present invention.
Figure 9:
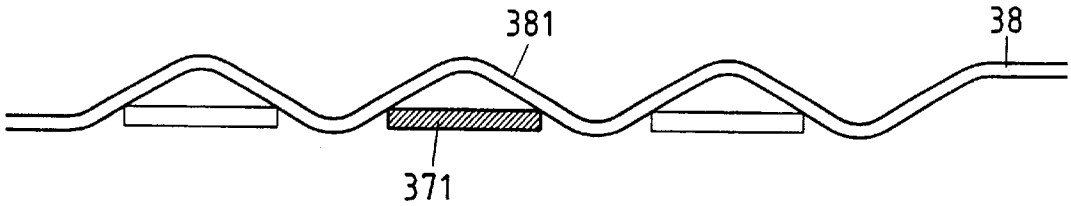
FIG. 9 shows a partial sectional view of the present invention.

As shown in FIGS. 3–9, a ratchet screwdriver 30 of the present invention comprises a main body 35, a ratchet rod 34, a shell tube 31, a switching ring 32, a pressing member 33, two stop blocks 36, a switching block 37, a locating member 38, and a recovery elastic piece.

The main body 35 is provided at one end with an outer threaded portion 354 and is further provided in the interior with a receiving space in which the ratchet rod 34, the switching block 37, and two stop blocks 36 are disposed.

The main body 35 is also provided in the outer edge thereof with two receiving holes 351 for two stop blocks 36 to be disposed in the receiving space of the interior of the main body. The main body 35 is further provided with an elastic piece retaining groove 352 and a locating member groove 353 in which the locating member 38 is retained. The recovery elastic piece 39 is retained in the elastic piece retaining groove 352. The shell tube 31 is fitted over the main body 35 such that the switching ring 32 is fitted over the shell tube 31, and such that the outer threaded portion 354 is engaged with an inner threaded portion 331 of the pressing member 33.

The ratchet rod 34 is provided with an annular groove 342 and a ratchet tooth 341 and is capable of one-way position confinement.

The shell tube 31 is fitted over the main body 35 and is provided at one end with the switch ring 32 which is provided with a retaining groove 321 for retaining a protruded block 371 of the switching block 37.

The pressing member 33 is provided in the inner wall with inner threads 331 which are engaged with the outer threaded portion 354 of the main body 35 for locating the switching ring 32 and the shell tube 31 on the main body 35.

The two stop blocks 36 are disposed in the interior of the main body 35 so as to cooperate with the ratchet tooth 341 of the ratchet rod 34.

The switching block 37 is provided with a protruded block 371 and is disposed in the interior of the main body 35 such that the switching block 37 is retained in the annular groove 342 of the ratchet rod 34, such that the switching block 37 presses against the stop blocks 36, and such that the protruded block 371 of the switching block 37 is retained in the retaining groove 321 of the switching ring 32.

The locating member 38 is provided with a locating segment 381 and a fixation end 382. The locating segment 381 is retained in the locating member retaining groove 353 of the main body 35.

The recovery elastic piece 39 is of a curved construction and is retained in the elastic piece retaining groove 352 of the main body 35 such that the recovery elastic piece 39 is rested against the two stop blocks 36.

In operation, the tip is retained by the ratchet rod 34. As the switching ring 32 is turned, the switching block 37 is linked to turn on the annular groove 342 of the ratchet rod 34, thereby causing one of the two pointed top portions of the switching block 37 to push one stop block 36 upward to move away from the rotating track of the ratchet tooth 341. the Other one of the two pointed top portions of the switching block 37 moves away from other stop block 36. As a result, the ratchet screwdriver 30 is capable of one-way rotation.

I claims:

1. A ratchet screwdriver comprising:

a main body having an outer threaded portion at one end thereof, said main body having a receiving space in an interior thereof, said main body having a retaining groove and a locating groove;

a shell tube fitted over said main body, said shell tube having a switching ring at one end thereof, said shell tube having a retaining groove therein;

a pressing member having inner threads in an inner wall thereof, said inner threads engaged with said outer threaded portion of said main body, said pressing member retaining said switching ring and said shell tube on said main body;

a ratchet rod having an annular groove and ratchet teeth, said ratchet rod disposed in said receiving space of said main body;

two stop blocks disposed in said receiving space of said main body, said two stop blocks cooperative with said ratchet teeth of ratchet rod;

a switching block disposed in said receiving space of said main body, said switching block having a protruded block, said switching block retained in said annular groove of said ratchet rod such that said switching block bears against said stop blocks, said protruded block of said switching block being retained in said retaining groove of said switching ring;

a locating member having a locating segment and a fixation end, said locating segment being retained in said locating groove of said main body; and a recovery elastic piece retained in said retaining groove of said main body, said recovery elastic piece having ends bearing respectively on said stop blocks on a side of said stop blocks opposite said switching block.

* * * * *